United States Patent [19]

Stearns

[11] 4,161,979

[45] Jul. 24, 1979

[54] METHOD OF AND APPARATUS FOR FLUSHING AN AUTOMOBILE COOLING SYSTEM

[76] Inventor: Earl J. Stearns, 62 Flushing Ave., Fairfield, Conn. 06432

[21] Appl. No.: 790,325

[22] Filed: Apr. 25, 1977

[51] Int. Cl.[2] ..... F28G 9/00

[52] U.S. Cl. ..... 165/95; 123/41.14; 123/198 R; 134/24; 134/98; 134/103; 134/169 A

[58] Field of Search ..... 165/95; 134/22 C, 24, 134/98, 166 R, 169 A; 123/41.01, 41.14, 198 R

[56] References Cited

U.S. PATENT DOCUMENTS

| | | | |
|---|---|---|---|
| 2,222,516 | 11/1940 | Powell et al. | 134/168 X |
| 2,681,657 | 6/1954 | Griffith | 134/98 |
| 3,115,145 | 12/1963 | Monteath | 134/98 X |
| 3,409,218 | 11/1968 | Moyer | 165/95 X |
| 4,083,399 | 4/1978 | Babish et al. | 165/95 |

*Primary Examiner*—Ronald H. Lazarus
*Assistant Examiner*—Margaret LaTulip
*Attorney, Agent, or Firm*—Wooster, Davis & Cifelli

[57] ABSTRACT

A two-cycle method for flushing an automobile cooling system and apparatus associated therewith. The method comprises cutting a hose between a water pump and a heater of a standard automobile cooling system. A pressurized air and water mixture is then introduced into the heater end of the cut hose, and after circulating through the cooling system, it exits through an opening in the top of a radiator which is normally sealed by a radiator cap. When this exiting water becomes clear, the second cycle is begun. The air and water mixture is introduced into the radiator opening and it circulates through the system in the opposite direction eventually exiting from the heater end of the cut hose. The apparatus of this invention includes a flow-through radiator cap which replaces the standard radiator cap, a plug which seals the water pump end of the cut hose and an "X" connector which by means of a pair of diverter valves directs the flow of the air and water into either the cut hose or the radiator opening. A mixer chamber is also provided which combines the pressurized air and water obtained from separate sources.

14 Claims, 5 Drawing Figures

METHOD OF AND APPARATUS FOR FLUSHING AN AUTOMOBILE COOLING SYSTEM

BACKGROUND OF THE INVENTION

This invention relates to a method of and apparatus for flushing a cooling system of an automobile engine.

The cooling systems in automobiles are fairly standard and generally comprise a radiator which is linked by hoses to both an engine block and a water pump. A heater is also provided between the pump and the engine block itself. The cooling system, therefore, consists of a number of flow paths through which water or coolant is circulated when the engine is in operation thereby reducing the engine operating temperature and correspondingly reducing the possibility of damage to the engine components themselves. Due to the nature of the automotive cooling system, however, sediment and deposits, such as rust, scale and the like, will build up inside the hoses and various elements over a period of time. This results in inefficient operation of the system, and in extreme cases can even cause the system itself to actually become blocked. To prevent this, it is generally considered advisable in the automotive industry for the cooling system to be flushed at periodic intervals and the water or coolant contained therein to be replaced.

In the prior art, the most common type of cooling system flushing is accomplished by draining the cooling system and then running the engine while fresh water is introduced into the system by means of a hose attached to an opening in the top of the radiator. This method, however, is ineffective in removing the rust and scale which has built up as it provides for only a unidirectional flow. Additional apparatus is known in the prior art for improving this method which consists of the use of a mixer chamber which combines pressurized air and water. This combination provides a more effective scrubbing action inside the cooling system itself than with water alone, but nevertheless does not remove all the rust and scale.

A more efficient method of cleaning the automotive cooling system is known in the prior art which consists of a four-cycle operation using the pressurized air and water combination. This method employs four separate flow-through steps each of which covers a different combination sequence of the individual elements of the cooling system itself. While this results in a much cleaner flushing, the process is complex and requires a number of costly items of equipment. Further, in view of the nature of the number of connections that are involved and the location where they must be made, this method is very difficult to employ. Therefore, while the four-cycle method does provide an effective flushing, it is much more expensive and more difficult to operate. Nevertheless, despite the drawbacks in terms of efficiency, cost and ease of operability, these methods and this apparatus for flushing automobile cooling systems are well-known and widely used.

SUMMARY OF THE INVENTION

The method of and apparatus for flushing an automobile cooling system according to the invention herein is more efficient and easier to operate than the prior art flushing systems. The apparatus of this invention generally comprises four basic parts which are an "X" connector, a flow-through radiator cap, a hose plug and a mixer chamber. When in operation, this apparatus provides a means for a two-cycle flushing according to the method of this invention.

The apparatus of this invention is installed by initially cutting a hose between a heater and a water pump in a standard automobile cooling system. The plug is then inserted into the water pump end of the cut hose. At the same time, the flow-through radiator cap replaces a standard sealing type of radiator cap normally covering a top opening in the automobile radiator. This, in effect, creates a flow path through the entire cooling system from the now cut radiator hose through the heater, to an engine block, back to the water pump and up through the radiator and finally out the flow-through radiator cap.

The "X" connector itself is comprised of a pair of vertical pipes which are interconnected by an independent pair of crossover pipes. A pair of diverter values are provided so that any flow through the "X" connector is either through the vertical pipes or through the crossover pipes. The output of the mixer chamber, which combines pressurized air and water, is attached to one end of a vertical pipe of the "X" connector. The opposite end of this vertical pipe is connected to the open end of the cut heater hose. At the same time, the flow-through radiator cap is connected to one end of the opposite vertical pipe for the "X" connector which directs any flow from the cap to a drain.

The method of this invention is essentially a two-cycle one. When the mixer chamber is turned on, the combination of water and pressurized air flow through the first vertical pipe of the "X" connector and into the cut end of the heater-water pump hose. This combination of water and air circulates through the entire cooling system as previously explained and exits at the flow-through radiator cap where it is directed to the drain. When the draining water becomes clear, the system has been essentially cleaned in the first cycle, and the valves of the "X" connector are turned so that the flow in and out of the "X" connector is through both of the crossover pipes. In the second cycle, the output of the mixer chamber, therefore, enters the cooling system through the flow-through radiator cap. The combination of air and water mixture proceeds through the system in the reverse direction and exits through the cut water pump-heater hose. From there, it is directed through one of the crossover pipes of the "X" connector into the drain. The entire cooling system is cleaned effectively in a two-cycle operation which is easy to accomplish as it requires only simple connections which do not have to be altered or changed for either of the operating cycles. When the cleaning is complete, the end of the plug in the water pump hose is removed and the hose is resealed.

Accordingly, a principal object of the present invention is to provide a method whereby an automobile cooling system can be efficiently cleaned.

Another object of the present invention is to provide an apparatus for the purpose of flushing the automotive cooling system which is inexpensive and can be easily installed.

Other and more specific objects of the invention will be in part obvious and will in part appear from the following description of the preferred embodiments taken together with the drawings.

DRAWINGS

The same reference numbers refer to the same elements throughout the various Figures.

DESCRIPTION OF THE PREFERRED EMBODIMENTS

Figure 1:
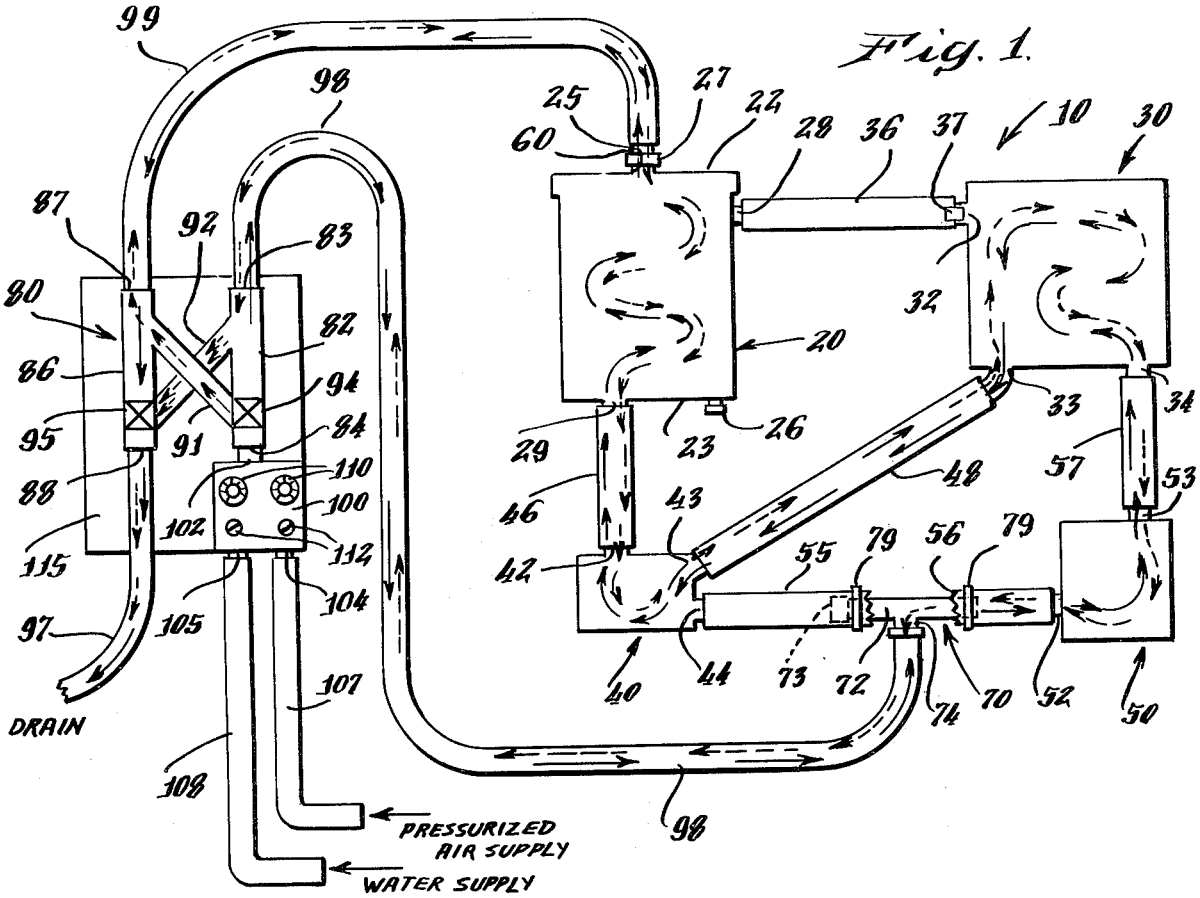
FIG. 1 is a block diagram of the apparatus of this invention attached to an automobile cooling system.

Referring now to FIG. 1, an automobile cooling system is shown at 10. The cooling system 10 generally comprises four main elements which are a radiator 20, an engine block 30, a water pump 40 and a heater 50. Under operating conditions, the cooling system 10 is sealed and filled with water or coolant which is circulated through the entire system by the water pump 40.

As shown in FIG. 1, the radiator 20 has a top 22 and a bottom 23. A radiator opening 25 is disposed in the top 22. The radiator opening 25 has a lip 27 disposed around it, and when the cooling system is in operation, this radiator opening 25 would be covered with a standard type of sealing radiator cap (not shown) secured to the lip 27. The radiator 20 also has a drain plug 26 located in its bottom 23 which is used to drain the coolant from the cooling system 10. The drain plug 26 would be closed when the cooling system 10 is being flushed in accordance with the method and apparatus of the invention as described herein. The radiator 20 also has a side opening 28 which is disposed near the top 22 and a lower opening 29 which is disposed near the bottom 23. Both the openings 28, 29 are adapted to receive hoses.

The engine block 30 has a first opening 32, a second opening 33 and a third opening 34 all of which are adapted to receive hoses. The first opening 32 is connected by a radiator-engine block hose 36 to the side opening 28 of the radiator 20. A thermostat 37 is disposed at the first opening 32 of the engine block 30, and the thermostat 37 effectively blocks radiator-engine block hose 36 when the cooling system 10 is not actually in operation.

The water pump 40 has a first opening 42, a second opening 43 and a third opening 44 all of which are also adapted to receive hoses. The first opening 42 of the water pump 40 is connected to the lower opening 29 of the radiator 20 by a radiator-water pump hose 46. The second opening 43 of the water pump 40 is similarly connected to the second opening 33 of the engine block 30 by an engine block-water pump hose 48.

As also shown in FIG. 1, the heater 50 is disposed between the engine block 30 and the water pump 40. The heater 50 has a first opening 52 which is connected by a water pump-heater hose 55 to the third opening 44 of the water pump 40. The heater 50 also has a second opening 53 which is similarly connected to the third opening 34 of the engine block 30 by an engine block-heater hose 57. Consequently, the cooling system 10 has a number of flow paths between the four basic elements.

Figure 2:
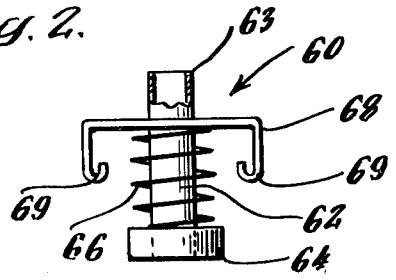
FIG. 2 is an enlarged side view of the flow-through radiator cap of this invention.

A method for flushing this automobile cooling system 10 according to the invention herein comprises a number of individual steps. Initially, the sealing radiator cap (not shown) is removed from the radiator opening 25 which depressurizes the cooling system 10. A flow-through cap 60, as shown in FIG. 2, is then inserted in the radiator opening 25. The flow-through cap 60 is comprised of a hollow, central cylindrical core 62 having a top 63 adapted to receive a hose and a sealing collar 64 disposed around its bottom. The sealing collar 64 is adapted to be received by the radiator opening 25 of the radiator 20 so that the outside edge of the collar 64 fits against the inside of the radiator opening 25 thereby preventing any fluid from leaving the radiator 20 except through the hollow central core 62 of the flow-through radiator cap 60. A spring 66 is disposed above the sealing collar 64, and the spring 66 supports a cover 68. The cover 68 has a pair of J-shaped flanges 69 disposed on opposite sides and extending downwardly therefrom. When the flow-through cap 60 is in place, the cover 68 is pressed downward against the spring 66 so that the flanges 69 become hooked under the lip 27 of the radiator opening 25 of the radiator 20. This arrangement is similar to the attaching arrangement of the standard sealing type of radiator cap. When this is accomplished, the flow-through cap 60 is secured in place. However, unlike the standard radiator cap, the fluid inside the cooling system 10 can escape through the hollow central core 62.

Figure 3:
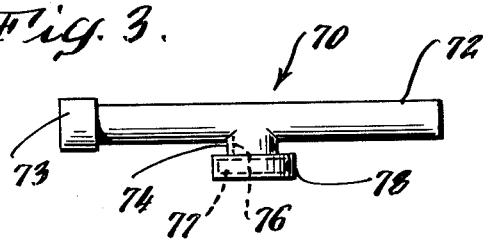
FIG. 3 is an enlarged side view of a "T" plug.

When the flow-through cap 60 has been installed, a cut 56 is made in the water pump-heater hose 55 at its approximate midpoint, as shown in FIG. 1. A plug 70, as best shown in FIG. 3, is then inserted through the cut 56 into the water pump end of the hose 55. The plug 70 consists of a hollow main tube 72 which is cylindrical and open at both ends. One end of the tube 72 is adapted to receive a removable cap 73. The tube 72 also has a "T" connector 74 mounted on it near its midpoint. The "T" connector 74 is cylindrical and has an internal passageway 76 which extends longitudinally therethrough and internally connects with the hollow interior of the tube 72. A lip 77 surrounds the end of the "T" connector 74 opposite the tube 72. A "T" connector cap 78 is adapted to fit over the lip 77 and when in place, it seals the "T" connector passageway 76.

With the removable cap 73 attached to one end of the main tube 72, the plug 70 is installed in the cooling system 10 so that the capped end of the tube 72 is inserted into the water pump end of the cut water pump-heater hose 55. The opposite end of the tube 72 is then inserted into the heater end of the water pump-heater hose 55, and the plug 70 is secured in place by clamps 79. Because of the tube cap 73, no fluid can flow from the water pump 40 directly to the heater 50 as would occur in normal operation of the cooling system 10. Instead, a fluid path is provided through the passageway 76 of the "T" connector 74 through the tube 72 and into the heater 50.

Figure 5:
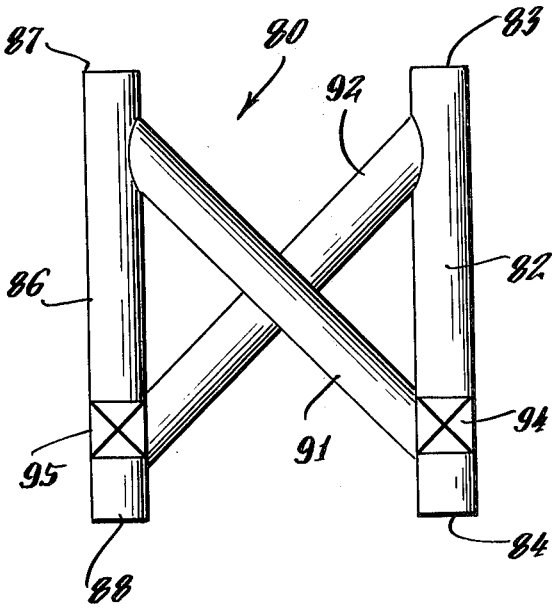
FIG. 5 is an enlarged side view of the "X" connector.

As shown in FIGS. 1 and 5, an "X" connector 80 is next connected to the cooling system 10. The "X" connector 80 consists of a first vertical pipe 82 having a top opening 83 and a bottom opening 84. The "X" connector 80 also has a similar second vertical pipe 86 mounted parallel to the first vertical pipe 82. The second vertical pipe 86 has a top opening 87 and a bottom opening 88. As best shown in FIG. 5, the end of the first vertical pipe 82 near the bottom opening 84 is internally connected to the upper end of the second vertical pipe 86 near its top opening 87 by a first crossover pipe 91. Similarly, the end of the first vertical pipe 82 near its top opening 83 is internally connected to the lower end of the second vertical pipe 86 near its bottom opening 88 by a second crossover pipe 92. The crossover pipes 91, 92 are independent of each other and do not interconnect. A first diverter valve 94 is located at the junction of the first crossover pipe 91 and the first vertical pipe 82. Depending upon the alignment of the first diverter valve 94, a flow is passed either from the bottom opening 84 straight up through the first vertical pipe 82 and out the top opening 83 or from the bottom opening 84 through the first crossover pipe 91 and out the top opening 87 of the second vertical pipe 86. A second diverter valve 95 is located at the junction of the second crossover pipe 92 and the second vertical pipe 86 and operates in the same manner to either direct a flow through the second vertical pipe 86 or through the second crossover pipe 92.

Referring now to FIG. 1, the "X"0 connector 80 is attached to the automobile cooling system 10 in the following manner. A first flexible hose 98 is connected from the top opening 83 of the first vertical pipe 82 to the "T" connector 74 of the plug 70. The "T" connector cap 78 is not in place at this time and therefore a flow path is created through the first vertical pipe 82, through the first flexible hose 98, through the plug 70 and into the heater 50. At the same time, a second flexible hose 99 is connected to the top opening 87 of the second vertical pipe 86 of the "X" connector 80. The end of this second flexible hose 99 opposite the "X" connector 80 is attached over the top 63 of the central core 62 of the flow-through radiator cap 60 mounted on the radiator 20. A drain hose 97 is then connected from the bottom opening 88 of the second vertical pipe 86 to a drain (not shown). In operation, the method according to the invention herein is essentially a two-cycle process. For the first cycle, the diverter valves 94, 95 are selectively arranged to permit a fluid flow only through the respective vertical pipes 82, 86. Water under pressure is then fed into the bottom opening 84 of the first vertical pipe 82. The water (shown in solid lines) then proceeds through the first vertical pipe 82, out its top opening 83 and into the first flexible hose 98. From there, the water enters the cooling system 10 through the plug 70, and it circulates from the heater 50 through the engine block-heater hose 57 and into the engine block 30 itself. As the thermostat 37 prevents a flow through the radiator-engine block hose 36, the water is directed out of the engine block 30 and through the engine block-water pump hose 48 to the water pump 40. After the water circulates through the water pump 40, it proceeds into the radiator 20 through the radiator-water pump hose 46. The water circulates through the radiator 20 from the bottom to the top and it finally exits through the central core 62 of the flow-through radiator cap 60. The water has essentially been circulated through the entire automobile cooling system 10. The exiting water is directed by the second flexible hose 99 back to the "X" connector 80 where it flows into the top opening 87 of the second vertical pipe 86. It proceeds through the second vertical pipe 86 to its bottom opening 88. From there, the drain hose 97 routes it to the drain. When the water from the drain hose 97 becomes substantially clear, the first cycle is complete.

When the first cycle is finished, the diverter valves 94, 95 are placed in their opposite mode so that they will direct the flow through the respective crossover pipes 91, 92. In this configuration, the pressurized water flows from the bottom opening 84 of the first vertical pipe 82 up through the first crossover pipe 91 and out the top opening 87 of the second vertical pipe 86. Due to the status of the second diverter valve 95, this flow cannot pass down the second vertical pipe 86 to the drain hose 87, and, therefore, the water proceeds through the second flexible hose 99 and into the top of the radiator 20 by means of the flow-through radiator cap 60. The water passes through the automobile cooling system 10 in the opposite direction as before, as shown by the dotted lines in FIG. 1, and it exits through the "T" connector 74 of the plug 70. The first flexible hose 98 directs this water into the top opening 83 of the first vertical pipe 82 where it flows through the second crossover pipe 92, through the second diverter valve 95 and out the bottom opening 88 to the drain hose 97. Because of the status of the first diverter valve 94, the exiting water cannot pass through the first vertical pipe 82 but must proceed through the second crossover pipe 92. When the exiting water becomes clear after the second cycle, the cooling system 10 is completely flushed.

The scrubbing or cleaning action of the water can be enhanced by the use of a mixer chamber 100. The mixer chamber 100 is a well-known device in the prior art and serves to combine the water with a source of pressurized air. The mixer chamber 100 has an output 102 and a pair of inputs 104, 105. An air hose 107 from a pressurized air supply (not shown) is attached to one input 104 of the mixer chamber 100. At the same time, a water hose 108 is attached to the other input 105. The output 102 is then connected to the bottom opening of the first vertical pipe 82 of the "X" connector 80, as shown in FIG. 1. A pair of gauges 110 are provided on the mixer chamber 100 to monitor the respective rates of flow of air and water, and a pair of valves 112 is also provided to control those rates of flow. For convenience, both the mixer chamber 100 and the "X" connector 80 can be held in a single storage compartment 115.

When the flushing is complete, the capped end of the tube 72 of the plug 70 is taken out of the water pump end of the hose 55. The tube cap 73 is removed, and the tube 72 is then reinserted into the hose 55 and again secured in place by the clamps 79. The first flexible hose 98 is then removed from the "T" connector 74 and the "T" connector cap 78 is installed. This effectively reconnects the water pump-heater hose 55. At the same time, because the plug 70 is left in the system, it is readily available for use when the cooling system 10 must be flushed again. The second flexible hose 99 is then removed and the flow-through radiator cap 60 is replaced with a standard radiator cap after the cooling system 10 has been refilled with coolant.

Figure 4:
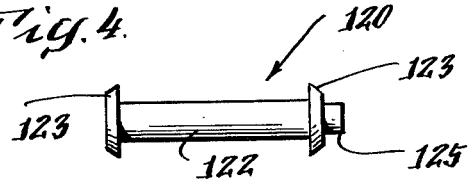
FIG. 4 is an enlarged side view of another plug.

Another type of plug 120 which may be used is shown in FIG. 4. This plug 120 comprises a hollow tube 122 having flanges 123 at each end. A removable cap 125 is inserted into one end of the tube 122 and the opposite end of the tube 122 is placed in the water pump end of the cut water pump-heater hose 55. With this plug 120 installed, the first flexible hose 98 is then connected directly to the heater end of the cut hose 55. When the flushing has been completed, the first flexible hose 98 is removed, and the tube 122 is uncapped. The formerly capped end of the tube 122 is thereupon inserted into the heater end of the cut hose 55, and the plug 120 is secured in place.

It should be obvious that the method of this invention could be in practice in a variety of ways. For example, the water pump-engine block hose might be cut and the water introduced to the engine block end. Other hoses might also be cut, but at least with the arrangement of most cooling systems, the use of other hoses would not permit such a complete flow through, as additional hose and elements might be by-passed. It should also be noted that a different type of flow-through radiator cap might be used or the second flexible hose attached directly to the radiator opening itself. Further, the cleaning fluid used for the flushing may be other than the water or the water and air combination as described herein.

From the foregoing description of the invention and the discussion of the prior art, the numerous advantages and improvements incident to this invention will now be apparent to those skilled in the art.

Accordingly, the above description of the invention is to be construed as illustrative only, rather than limiting. The invention is limited only by the scope of the following claims.

I claim:

1. An apparatus for flushing an automobile cooling system, said cooling system comprising a radiator having a radiator cap opening, a water pump, a heater and an engine block which are interconnected by a series of hoses, wherein the apparatus comprises a first flexible hose one end of which is removably connected to a heater opening normally receiving a hose between said water pump and said heater, means for connecting said first flexible hose to said heater, plugging means to prevent any fluid flow through said water pump to heater hose, a second flexible hose one end of which is removably connected to said radiator cap opening, means for connecting said second flexible hose to said radiator cap opening, a pressurized supply means for a flow of a cleaning fluid, and an "X" connector adapted to receive the ends of said first and second flexible hoses opposite said cooling system, said "X" connector being connected to said supply means, said "X" connector having a valve means whereby said flow of said cleaning fluid from said supply means is directed into said first flexible hose while at the same time the exiting flow of said cleaning fluid from said radiator cap opening is directed to an outlet of said "X" connector, said valve means also being capable of being selectively reset so as to redirect said flow of cleaning fluid into said second flexible hose while at the same time directing the exiting flow of said cleaning fluid from said heater through said first flexible hose to said outlet.

2. An apparatus for flushing an automobile cooling system as defined in claim 1 wherein said "X" connector comprises a first vertical pipe having a top opening and a bottom opening at opposite ends, a second vertical pipe having a top opening and a bottom opening at opposite ends, said "X" connector having a first crossover pipe which internally connects the end of said first vertical pipe near its bottom opening with the top of said second vertical pipe near its top opening, said "X" connector also having a second crossover pipe which internally connects the end of said first vertical pipe near its top opening with the end of said second vertical pipe near its bottom opening, the end of said first flexible hose opposite said heater being connected to said top opening of said first vertical pipe of said "X" connector and the end of said second flexible hose opposite said radiator cap opening being connected to said top opening of said second vertical pipe.

3. An apparatus for flushing an automobile cooling system as defined in claim 2 wherein said valve means comprises a first diverter valve disposed in said first vertical pipe of said "X" connector near its bottom opening so as to selectively direct the flow of cleaning fluid from the bottom opening to either the top opening of said first vertical pipe or through the first crossover pipe and to the top opening of said second vertical pipe, and a second diverter valve disposed in said second vertical pipe near its bottom opening so as to selectively direct to said outlet the exiting flow of said cleaning fluid either from the top opening of said second vertical pipe or from the top opening of said first vertical pipe through said second crossover pipe.

4. An apparatus for flushing an automobile cooling system as defined in claim 3 wherein said bottom opening of said second vertical pipe of said "X" connector comprises said outlet, one end of a drain hose being connected to said outlet and the opposite end of said drain hose being placed in a drain.

5. An apparatus for flushing an automobile cooling system as defined in claim 4 wherein an output of said pressurized supply means for the flow of said cleaning fluid is connected to said bottom opening of said first vertical pipe of said "X" connector.

6. An apparatus for flushing an automobile cooling system as defined in claim 1 wherein said hose between said water pump and said heater is cut apart, and said plugging means comprises a hollow cylindrical tube having a removable cap on one end, the capped end of said tube being inserted into the water pump end of said cut hose, and the end of said tube opposite said cap being inserted into the heater end of said cut hose, said tube also having a cylindrical "T" connector mounted near its midpoint and extending radially therefrom, said "T" connector having a hollow, cylindrical passageway, said passageway extending longitudinally through said entire "T" connector and being internally connected with the hollow interior of said tube.

7. An apparatus for flushing an automobile cooling system as defined in claim 6 wherein said means for connecting said first flexible hose to said heater comprises the end of said "T" connector opposite said tube being adapted to receive the heater end of said first flexible hose.

8. An apparatus for flushing an automobile cooling system as defined in claim 7 wherein said passageway of said "T" connector has a "T" connector cap and when the flushing operation is complete and said first flexible hose is removed, said "T" connector cap being attached thereby effectively reconnecting said hose between said water pump and said heater.

9. An apparatus for flushing an automobile cooling system as defined in claim 1 wherein said hose between said water pump and said heater is cut apart, and said plugging means comprises a hollow tube with a removable cap on one end, said tube being inserted into the water pump end of said cut hose, and said first flexible hose being directly connected to the heater end of said cut hose.

10. An apparatus for flushing an automobile cooling system as defined in claim 9 wherein said cap is removed from said tube when said flushing operation is complete and said first flexible hose is removed, said tube being additionally inserted into the heater end of said cut hose and secured in place thereby effectively reconnecting said cut hose.

11. An apparatus for flushing an automobile cooling system as defined in claim 1 wherein said means for connecting said second flexible hose to said radiator cap opening comprises a flow-through radiator cap secured in said radiator cap opening, said flow-through radiator cap having a vertical, central core, said core being hollow, and when in place on said radiator, said central core providing a fluid path from the inside of said radiator, said central core of said flow-through radiator cap having a top which extends above said radiator, and said top being adapted to receive one end of said second flexible hose.

12. An apparatus for flushing an automobile cooling system as defined in claim 1 wherein said cleaning fluid is water.

13. An apparatus for flushing an automobile cooling system as defined in claim 1 wherein said pressurized supply means comprises a mixer chamber having an output and a pair of inputs, one of said inputs being connected to a source of pressurized water and the other of said inputs being connected to a source of pressurized air, said mixer chamber producing a combination of air and water at its output.

14. An apparatus for flushing an automobile cooling system as defined in claim 1 having a flow-through radiator cap, a plug with a "T" connector and a mixer chamber.

* * * * *